US010192531B1

(12) United States Patent
Cobb

(10) Patent No.: US 10,192,531 B1
(45) Date of Patent: Jan. 29, 2019

(54) NONSLIP INSTRUMENT PICK

(71) Applicant: Daryl Cobb, Clinton, NJ (US)

(72) Inventor: Daryl Cobb, Clinton, NJ (US)

( * ) Notice: Subject to any disclaimer, the term of this patent is extended or adjusted under 35 U.S.C. 154(b) by 0 days.

(21) Appl. No.: 15/724,263

(22) Filed: Oct. 3, 2017

Related U.S. Application Data

(60) Provisional application No. 62/471,069, filed on Mar. 14, 2017.

(51) Int. Cl.
*G10D 3/16* (2006.01)

(52) U.S. Cl.
CPC ..... *G10D 3/163* (2013.01)

(58) Field of Classification Search
CPC ..... G10D 3/08; G19D 3/163
See application file for complete search history.

(56) References Cited

U.S. PATENT DOCUMENTS

| | | | | |
|---|---|---|---|---|
| 3,648,558 | A | 3/1972 | Chenette | |
| 3,699,838 | A | 10/1972 | Montgomery | |
| 4,015,502 | A | 4/1977 | Strong | |
| 4,102,234 | A | 7/1978 | Brundage | |
| 8,492,630 | B1 | 7/2013 | Wonnacott | |
| 2004/0237754 | A1 | 12/2004 | Sogabe | |
| 2012/0192699 | A1* | 8/2012 | McVicker | G10D 3/163 84/322 |
| 2015/0122106 | A1* | 5/2015 | Spivey | G10D 3/163 84/322 |

* cited by examiner

*Primary Examiner* — Kimberly Lockett
(74) *Attorney, Agent, or Firm* — Integrity Patent Group, PLC; Edwin Wold

(57) ABSTRACT

An apparatus for a finger of a user to play a stringed instrument is disclosed herein. The apparatus for a finger of a user to play a stringed instrument includes a string pick and an elastic securing band or sleeve, which persistently secures the pick to a finger of a user. The apparatus for a finger of a user to play a stringed instrument allows users with compromised dexterity or reduced hand strength to play a stringed instrument with a single finger. It also allows musicians to easily change between different playing styles such as strumming, finger style, or pick play style through rotation of the string pick about the finger of a user.

20 Claims, 5 Drawing Sheets

NONSLIP INSTRUMENT PICK

CROSS REFERENCE TO RELATED APPLICATION

The present application is related to and claims priority to U.S. Provisional Patent Application No. 62/471,069 filed Mar. 14, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of an instrument picking device and more specifically relates to a stringed instrument pick.

2. Description of Related Art

When playing stringed instruments, it may pose difficulty for musicians to transition among various strum and pick styles while holding a stringed instrument pick. Further, musicians often drop instrument picks during play, which interrupts the musical flow and compromises enjoyment of the song. Additionally, guitarists and other musicians with reduced dexterity or hand strength may have trouble gripping a guitar pick between the thumb and finger throughout the song. A suitable solution is desired.

U.S. Pat. No. 4,015,502 to Jack C. Strong relates to a pick for string instruments. The described pick for string instruments includes a body member formed of a length of wire-like material has side extensions arranged to engage longitudinally the under portion of a finger adjacent each side. The body member has a front projecting portion comprising a string picking head, and a flexible strap is secured at opposite ends thereof to the side extensions of the body member for holding the pick on a musician's finger. The strap is adjustable in length to adjust to different size fingers and is also adjustable longitudinally along the side extensions. The body member preferably has the characteristics of spring steel wire whereby to be sufficiently rigid for picking but at the same time is bendable into selected shapes to provide various picking head arrangements and also to be made to conform to the contour of a musician's finger. The picking head may have a resilient picking surface for tone quality.

BRIEF SUMMARY OF THE INVENTION

In view of the foregoing disadvantages inherent in the known art of instrument picking devices, the present disclosure provides a novel nonslip instrument pick. The general purpose of the present disclosure, which will be described subsequently in greater detail, is to provide a nonslip instrument pick which allows a user to play an instrument with a single finger in different styles such as strumming, finger style, or pick play by rotation of the pick about the finger. Further, it allows users with compromised dexterity or reduced hand strength to play through use of an elastic band to secure it to the finger of a user.

An apparatus for a finger of a user to play a stringed instrument is disclosed herein. The apparatus for a finger of a user to play a stringed instrument includes a string pick configured to pick strings of the stringed instrument and an elastic securing band. The string pick and may have a tip end, a tail end opposite the tip end, a pick body extending between the tip end and the tail end that may be substantially flat, has a first flat face and a second flat face opposite the first flat face, a periphery about the pick body extending between the first flat face and the second flat face, and may be tapered at the tip end, the pick body also may have a pick axis extending between the tip end and the tail end, a grip axis normal to the pick axis and intersecting the first flat face and the second flat face, a pick length as measured between the tip end and the tail end along the pick axis, and a maximum pick width as measured normal to the pick axis and through the pick body, the maximum pick width greater than the finger diameter, the string pick may include a pair of opposing tail side tabs extending outwardly from the pick body, normal to both the pick axis and the grip axis, and defining the maximum pick width. The elastic securing band forms a loop about a band center axis, and may have a finger end, a pick end opposite the finger end, a band length extending between the finger end and the pick end parallel with the band center axis, a tube wall thickness, a tubular inner surface extending between the finger end and the pick end, and a tubular outer surface opposite the tubular inner surface and extending between the finger end and the pick end, the elastic securing band configured to couple with the string pick via the tail side tabs, and to secure the string pick to the finger of a user via a conformal fit against the finger.

A method of using an apparatus for a finger of a user to play a stringed instrument is also disclosed herein. The method of using the apparatus for a finger of a user to play a stringed instrument may comprise the steps of providing a string pick configured to pick strings of the stringed instrument as described above; providing an elastic securing band as described above; sliding the finger end of the elastic securing band onto the finger of the user; inserting the tail end of the string pick into the pick end of the elastic securing band as disposed around the finger of the user; rotating the string pick about the finger of the user; playing the stringed instrument with the string pick.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a nonslip instrument pick, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a picking device, and more particularly to a nonslip instrument pick as may be used to assist musicians to play a stringed instrument with a single finger that may have hand injury, pain or compromised dexterity. Additionally, the nonslip instrument pick may be rotated about the finger of a user to facilitate different styles of play. Further, the nonslip instrument pick of the present invention may aid in preventing dropping of the string pick during play.

Generally, the present disclosure provides for an apparatus for a finger of a user to play a stringed instrument, the apparatus having a stringed instrument pick that may be used by manually gripping the pick between the thumb and index finger, and playing a stringed instrument. The stringed instrument pick may also be elastically secured to a finger of a user by an elastic band or elastic sleeve circumscribing a finger of a user, and playing a stringed instrument. The elastic securing band may maintain a uniform radial compressive force about the finger of a user to persistently secure the stringed instrument pick to an outer surface of the finger of a user. When secured to the finger of a user, the stringed instrument pick may be manually rotated both clockwise and counter clockwise about the finger which may give the musician the option to readily transition from various styles of play, such as a finger-play style to a pick-play style to a strumming style. The stringed instrument pick may also be rotated as much as 360 degrees, a complete rotation, about the finger of a user if necessary. The stringed instrument pick may maintain its location on the finger of a user through location of the elastic securing band within a reduced width notch region disposed on opposing sides of the stringed instrument pick. The notch region may be sufficiently narrow to approximate the diameter of a finger of a user such that the pick may be easily rotated behind the finger when not required. Further, the notch region may reduce the need to grip the stringed instrument pick between the thumb and index finger. The stringed instrument pick is planar and made of rigid materials. The stringed instrument pick may have asymmetrical peripheral sides to inhibit contact between the periphery of the stringed instrument pick and the fingers of a user during a finger-play style. The stringed instrument pick further includes a mid-body indentation on both the left side and right side, the indentation keeps the securing band locked into position around the pick and allows the user to pick or strum freely without the need to grip the pick with thumb and index finger.

Referring now more specifically to the drawings by numerals of reference, there is shown in FIGS. 1-4B, various views of an apparatus 100 for a finger of a user 40 to play a stringed instrument.

Figure 1:
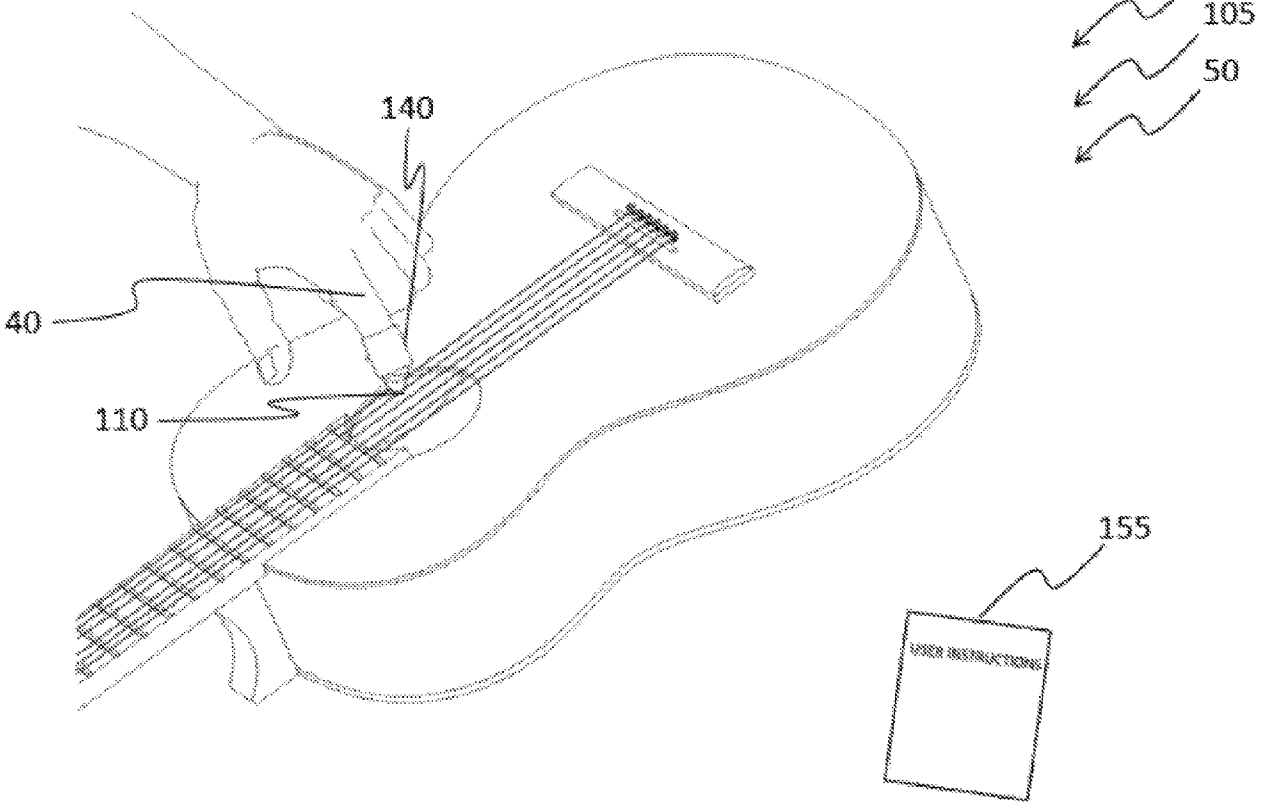
FIG. 1 is a perspective view of an apparatus for a finger of a user to play a stringed instrument during an 'in-use' condition, according to an embodiment of the present disclosure.

FIG. 1 shows an apparatus 100 for a finger of a user 40 to play a stringed instrument during an 'in-use' condition 30, according to an embodiment of the present disclosure. The apparatus 100 may include a string pick 110 configured to pick strings of the stringed instrument, coupled with an elastic securing band 140 configured to secure the string pick 110 to a finger of the user 40. Here, the apparatus 100 for a finger of a user 40 to play a stringed instrument may be beneficial for use by a user 40 to enable play using one finger, and further to facilitate a transition from a finger-play style to a pick-play style to a strumming style of play. These benefits assist musicians who have pain or injuries to the hand, and to prevent dropping the pick when changing playing styles.

According to one embodiment, the apparatus 100 for a finger of a user 40 to play a stringed instrument may be arranged as a kit 105. In particular, the apparatus 100 may further include a set of instructions, 155. The instructions 155 may detail functional relationships in relation to the structure of the apparatus 100 such that the apparatus for a finger of a user to play a stringed instrument can be used, maintained, or the like, in a preferred manner.

Figure 2B:
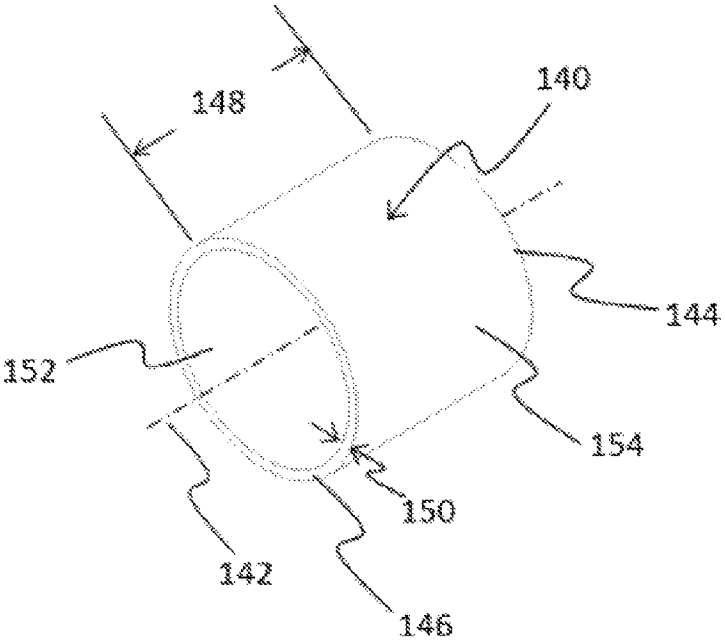
FIG. 2B is a perspective view of an elastic securing band of the apparatus of FIG. 1, the elastic securing band configured to circumscribe the finger of the user, according to an embodiment of the present disclosure.
Figure 2A:
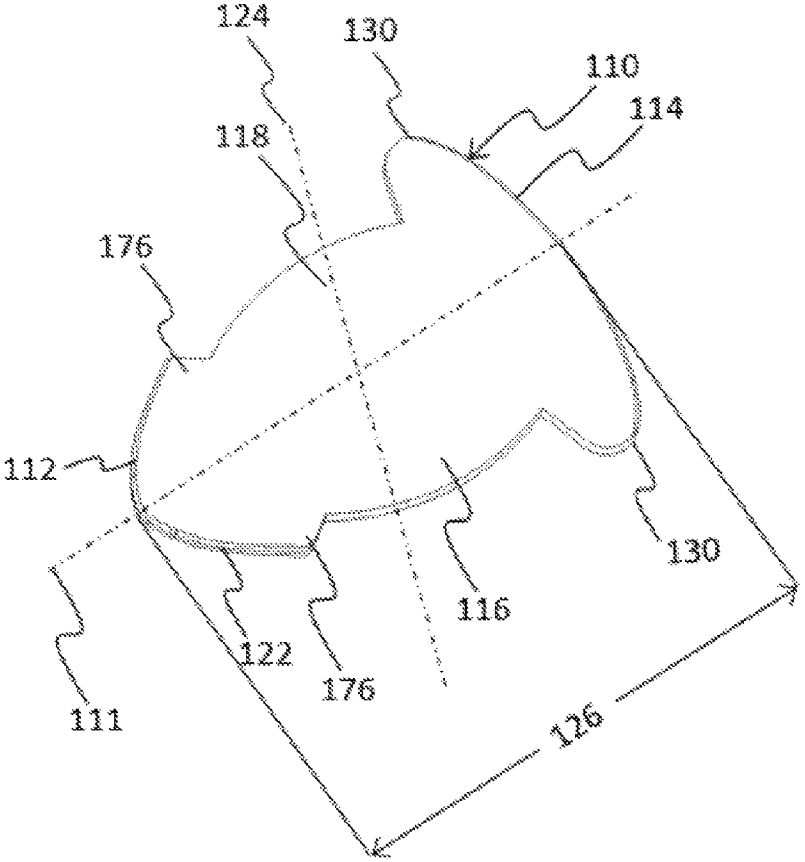
FIG. 2A is a perspective view of a string pick of the apparatus of FIG. 1, illustrating dimensions of the string pick, according to an embodiment of the present disclosure.

FIG. 2A is a perspective view of a string pick of the apparatus of FIG. 1, illustrating dimensions of the string pick, according to an embodiment of the present disclosure. Here, the string pick 110 is illustrated as configured to pick strings of the stringed instrument. The string pick 110 has a tip end 112, a tail end 114 opposite the tip end, a pick body 116 extending between the tip end and the tail end that is substantially flat, has a first flat face 118 and a second flat face 120 (FIG. 3A) opposite the first flat face 118, a periphery 122 about the pick body 116 (running circuit or circumscribing both flat faces 118, 120) extending between the first flat face 118 and the second flat face 120, and is tapered at the tip end 112.

The pick body 116 also has a pick axis 111 extending between the tip end and the tail end, a grip axis 124 normal to the pick axis and intersecting the first flat face and the second flat face. As shown, the pick body 116 may be symmetrical about the pick axis 111, however as discussed above, in other embodiments the pick body 116 may be asymmetrical about the pick axis 111. The pick body 116 also has a pick length 126 as measured between the tip end 112 and the tail end 114 along the pick axis 111.

The string pick 110 also includes a pair of opposing tail side tabs 130 extending outwardly from the pick body, in a direction normal to both the pick axis 111 and the grip axis 124. Similarly, the string pick 110 includes a pair of opposing tip side tabs 176 extending outwardly from the pick body, normal to both the pick axis 111 and the grip axis 124. According to one embodiment, and as illustrated, the tip side tabs 176 or the tail side tabs 130 may be rounded, for example, having a radius of curvature of at least about 0.040 inches (as measured in a plane that is normal to the grip axis 124). Beneficially, the rounding of the opposing tabs may prevent damage to the elastic band or sleeve during use and/or extend its life.

FIG. 2B is a perspective view of an elastic securing band 140 of FIG. 1, the elastic securing band configured to circumscribe the finger of the user, according to an embodiment of the present disclosure. The elastic securing band 140 is shown forming a loop about a band center axis 142. Similar to the string pick 110, the elastic securing band 140 has a finger end 144, a pick end 146 opposite the finger end, a band length 148 extending between the finger end 144 and the pick end 146, parallel with the band center axis 142. The elastic securing band 140 also has a tube wall thickness 150, a tubular inner surface 152 extending between the finger end 144 and the pick end 146, and a tubular outer surface 154 opposite the tubular inner surface 152 and extending between the finger end 144 and the pick end 146. The tube wall thickness 150 may have a preferential thickness of at least about 0.035 inch though this represents a non-limiting example of the tube wall thickness.

Also referring to FIG. 2A, the elastic securing band 140 is configured to couple with the string pick 110 via the tail side tabs 130 and the tip side tabs 176, and further configured to secure the string pick 110 to the finger of the user 40 (FIG. 1) via a conformal fit against the finger. When the apparatus 100 to play a stringed instrument is in an in-use condition 30 (FIG. 1), the elastic securing band 140 may engage with the string pick 110 such that the elastic securing band 140 persistently circumscribes the finger and grips or otherwise engages portions of the string pick 110 along its band length 148, and in between the tip side tabs 176 and the tail side tabs 130, and such that the string pick 110 is secured to the finger.

In some instances, it may be useful to provide increased grip, stickiness, or resistance to motion of the elastic securing band 140 (or the elastic sleeve 160 (FIG. 3B)). For example, the elastic securing band 140 (or the elastic sleeve 160) may be fabricated such that the tubular inner surface 152 has a greater coefficient of friction than the tubular outer surface 154. Beneficially, this may prevent movement of the securing band 140 or elastic sleeve 160 (and the string pick 110) during use. Further, the elastic securing band 140 or elastic sleeve 160 may be fabricated from flexible materials such as latex or silicone rubber, which may also be designed for contact with human skin over extended periods.

Figure 3B:
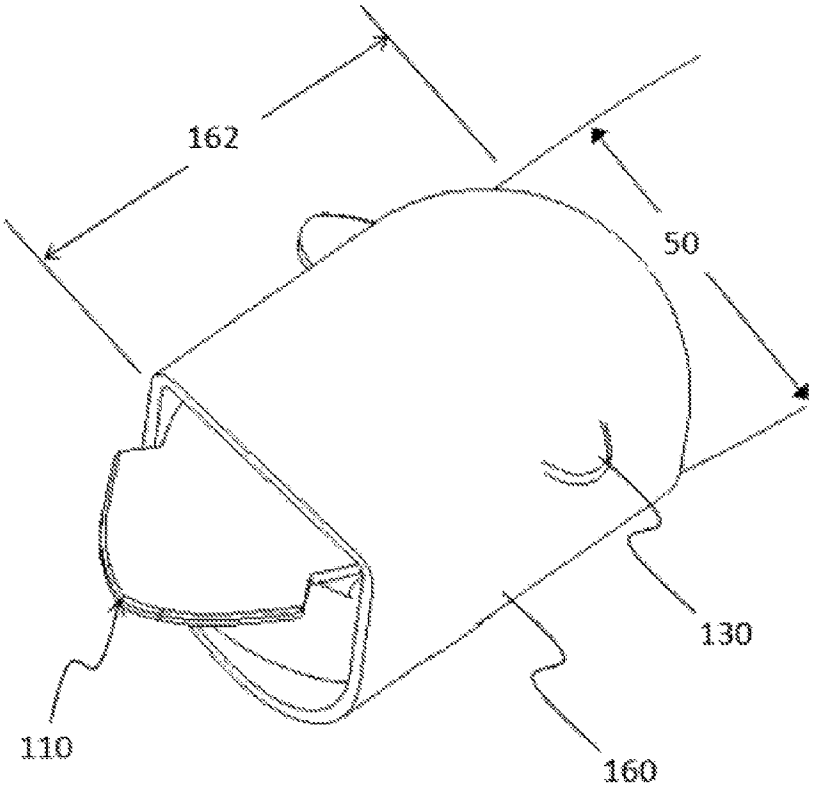
FIG. 3B is a perspective view of an apparatus for the finger of the user to play the stringed instrument, according to another embodiment of the present disclosure, where the elastic securing band is an elastic sleeve extending over the tail side tabs of the string pick.
Figure 3A:
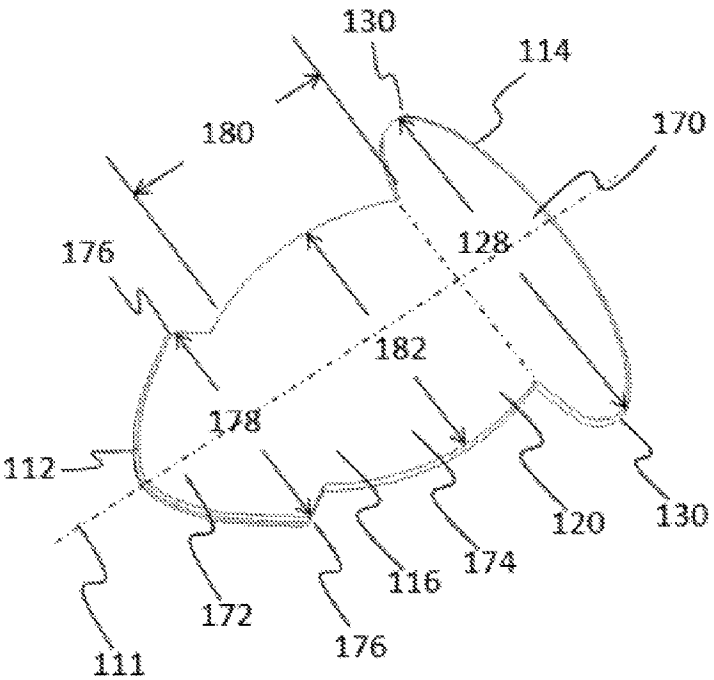
FIG. 3A is a perspective view of the string pick of FIG. 2A, illustrating additional dimensions of the string pick, according to an embodiment of the present disclosure.

FIG. 3A is a perspective view of the string pick of FIG. 2A, illustrating additional dimensions of the string pick, according to an embodiment of the present disclosure. Here, the string pick 110 is shown having a maximum pick width 128 as measured normal to the pick axis 111 and through the pick body 116. The maximum pick width 128 may be greater than a finger diameter 50.

As above, the pick body 116 may have a tail portion 170 proximate the tail end 114, a tip portion 172 proximate the tip end 112, and a notch portion 174 extending between the tip portion and the tail portion, as generally delineated by dashed lines. It is understood that each portion is generally defined relative to each other and need not have linear boundaries. The notch portion 174 may have a notch length 180, as measured between the tail portion 170 and the tip portion 172 along the pick axis 111. In some embodiments, the notch length 180 may be at least as long as the band length 148 (FIG. 2B).

Also as above, the tail portion 170 may include the pair of opposing tail side tabs 130, and the tip portion 172 may include the pair of opposing tip side tabs 176 extending outwardly from the pick body, both generally defined as being normal to both the pick axis 111 and the grip axis 124 (FIG. 2A). The maximum distance between the pair of opposing tail side tabs 130 (as measured normal to the pick axis 111 and through the pick body 116) may define the maximum pick width 128. Similarly, the maximum distance between the pair of opposing tip side tabs 176 (as measured normal to the pick axis 111 and through the pick body 116) may define a tip maximum width 178. The tip maximum width 178 may be less than the maximum pick width 128.

Likewise, the notch portion 174 may have a notch maximum width 182 as measured normal to the pick axis 111 and through the pick body 116. According to one embodiment, the notch maximum width 182 may be less than the maximum pick width 128 and greater than the tip maximum width 178. According to one embodiment, the notch portion 174 may have curved sides along the periphery 122. In particular, the notch portion may include a pair of opposing convex curves located on opposing sides of the notch portion and along the periphery 122. Each curve may extend the notch length 180 and define a section of the periphery 122. According to one embodiment, the pair of opposing convex curves may be symmetric. According to another embodiment, the pair of opposing convex curves may be asymmetric. For example, the pair of opposing convex curves may have different lengths and/or curvatures. Beneficially, the pair of opposing convex curves may assist with rotation and persistently securing the stringed instrument pick in a specific location on the finger of a user.

FIG. 3B is a perspective view of an apparatus 100 for the finger of the user to play the stringed instrument, according to another embodiment of the present disclosure, where the elastic securing band is an elastic sleeve extending over the tail side tabs of the string pick. Here, the elastic sleeve 160 may have a sleeve length 162 measured similar to the band length 148 (FIG. 2B), and may be configured to extend over and engage the tail side tabs 130 and to secure the string pick against the finger, also similar to the elastic securing band 140 (FIG. 2B). Likewise, here, the tail side tabs 130 of the string pick 110 may be engaged by the elastic sleeve 160 and may provide an anchoring effect around the tail portion 170 such that the tip end 112 of the string pick may be adjusted along the pick axis for optimal positioning during play. This anchoring effect around the tail portion 170 via the tail side tabs 130 and elastic sleeve 160 may also enable use of the string pick solely by a finger of a user. In some embodiments, the sleeve length 162 may equal or exceed the pick length 126 (FIG. 2A).

Figure 4B:
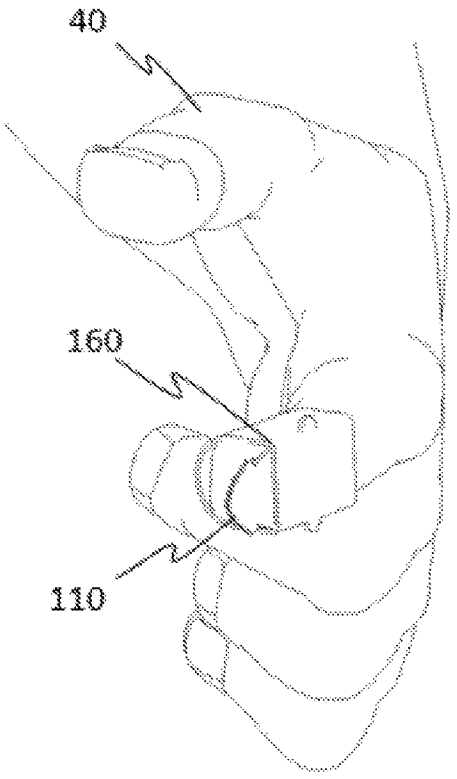
FIG. 4B is a perspective view of the apparatus of FIG. 4A, illustrating the apparatus as installed on the finger of the user where the string pick has been rotated to the fingernail side of the finger of the user to facilitate different types of play, according to an embodiment of the present disclosure.
Figure 4A:
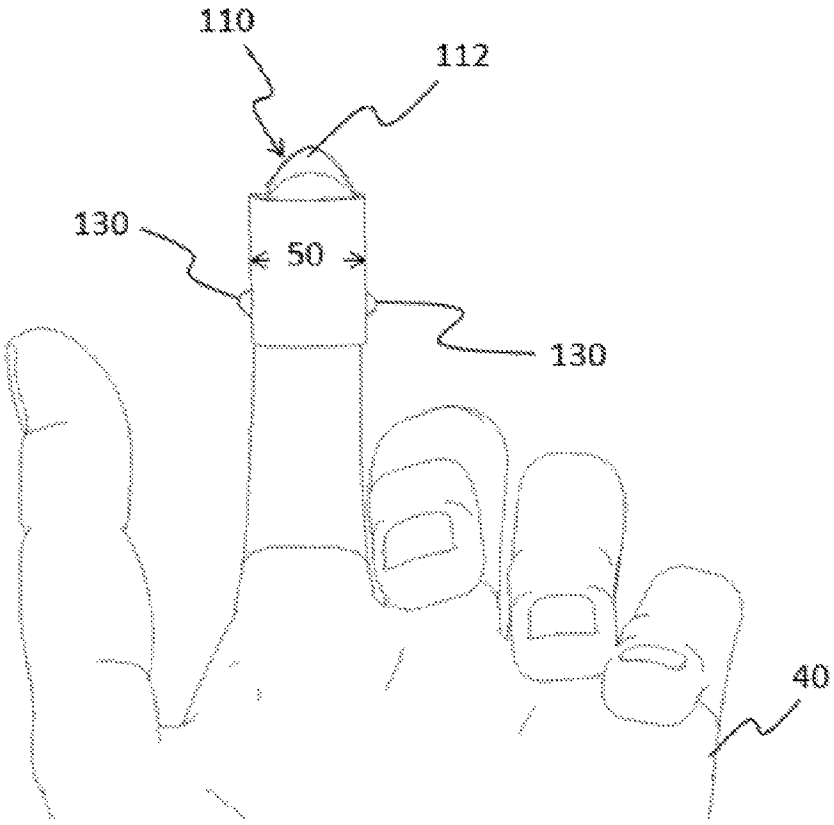
FIG. 4A is a perspective view of the apparatus of FIG. 3B, illustrating the apparatus as installed on the finger of the user and showing the finger width relative to the tail side tabs, according to an embodiment of the present disclosure.

FIG. 4A is a perspective view of the apparatus 100 of FIG. 3B, illustrating the apparatus as installed on the finger of the user 40, showing the tip end 112 of the string pick 110 and the finger width 50 relative to the tail side tabs 130, according to an embodiment of the present disclosure. As shown, in some embodiments, the notch maximum width 182 (FIG. 3A) may approximate the finger diameter 50. In other embodiments, the notch maximum width 182 may be greater than the finger diameter 50. In instances where the notch maximum width 182 is greater than the finger diameter 50, the elastic securing band (FIG. 2B) may be configured to tighten about the finger upon rotation of the string pick 110.

FIG. 4B is a perspective view of the apparatus of FIG. 4A, illustrating the apparatus as installed on the finger of the user 40, where the string pick 110 has been rotated within the elastic sleeve 160 to the fingernail side of the finger of the user 40 to facilitate different types of play, according to an embodiment of the present disclosure. The elastic securing band 140 (or elastic sleeve 160) may be configured to provide a radial compressive force against a circumference of the finger, which may allow for rotation of the string pick 110 to a position away from the pad of the finger, as illustrated.

Figure 5:
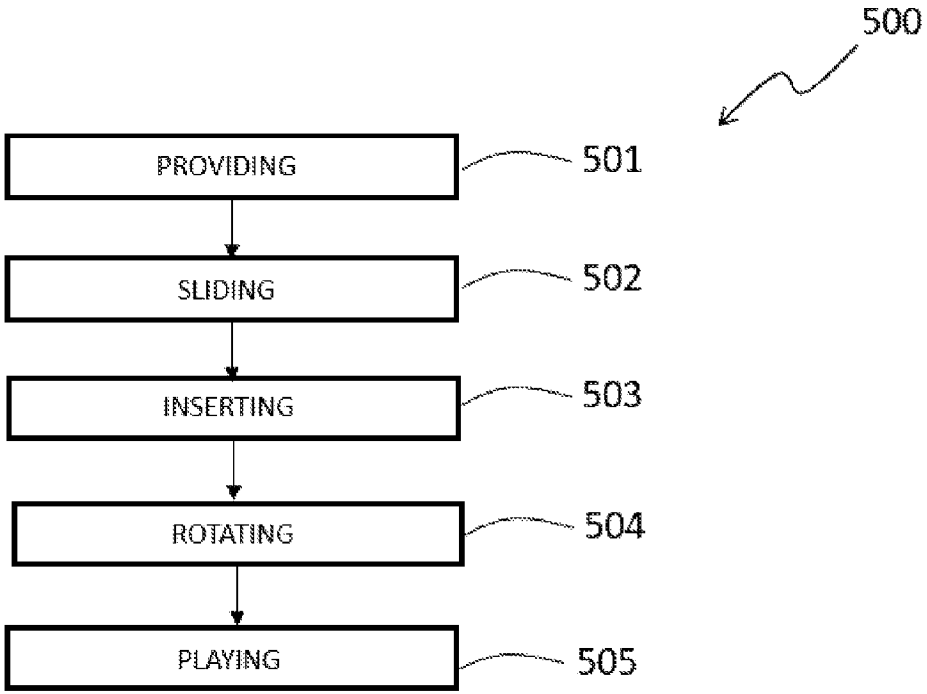
FIG. 5 is a flow diagram illustrating a method of use of the apparatus for a finger of a user to play a stringed instrument, according to an embodiment of the present disclosure.

FIG. 5 is a flow diagram illustrating a method of use of the apparatus 100 for a finger of a user to play a stringed instrument, according to an embodiment of the present disclosure. In particular, the method 500 of use of the apparatus 100 for a finger of the user 40 to play a stringed instrument may include one or more components or features of the apparatus 100 as described above. As illustrated, the method 500 for using the apparatus 100 for a finger of a user 40 to play a stringed instrument may include the steps of: step one 501, providing an apparatus 100 for a finger of a user 40 to play a stringed instrument, the apparatus 100 including a string pick 110 and an elastic securing band 140, the string pick 110 configured to pick the strings of a stringed instrument, having a tip end 112, a tail end 114 opposite the tip end, a pick body 116 extending between the tip end 112 and the tail end 114 that is substantially flat, having a first flat face 118 and a second flat face 120 opposite the first flat face, a periphery 122 about the pick body 116 extending between the first flat face 118 and the second flat face 120, and is tapered at the tip end, the pick body also having a pick axis 111 extending between the tip end and the tail end, a grip axis 124 normal to the pick axis 111 and intersecting the first flat face 118 and the second flat face 120, a pick length 126 as measured between the tip end 112 and the tail end 114 along the pick axis 111, and a maximum pick width 128 as measured normal to the pick axis 111 and through the pick body 116, the maximum pick width 128 greater than the finger diameter 50, the string pick including a pair of opposing tail side tabs 130 extending outwardly from the pick body 116, normal to both the pick axis 111 and the grip axis 124, and defining the maximum pick width 128, the elastic securing band 140 forming a loop about a band center axis 142, and having a finger end 144, a pick end 146 opposite the finger end, a band length 148 extending between the finger end 144 and the pick end 146 parallel with the band center axis 142, a tube wall thickness 150, a tubular inner surface 152 extending between the finger end 144 and the pick end 146, and a tubular outer surface 154 opposite the tubular inner surface and extending between the finger end 144 and the pick end 146, the elastic securing band 140 configured to couple with the string pick 110 via the tail side tabs 130, and to secure the string pick to the finger of a user 40 via a conformal fit against the finger; step two 502, sliding the finger end 144 of the elastic securing band 140 onto the finger of the user; step three 503, inserting the tail end 114 of the string pick into the pick end 146 of the elastic securing band as disposed around the finger of the user; step four 504, rotating the string pick 110 about the finger of the user; step five 505, playing the stringed instrument with the string pick 110.

It should be noted that step one 501, providing an apparatus 100 for a finger of a user 40 to play a stringed instrument, the apparatus including a string pick 110, and an elastic securing band 140 may be equally performed using the elastic sleeve 160, of the present disclosure. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for an apparatus for a finger of a user to play a stringed instrument, the apparatus comprising 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Those with ordinary skill in the art will now appreciate that upon reading this disclosure, and by their understanding the art of plectrum, including instrument picking devices and hand or finger picks for musical instruments, the apparatus disclosed may be modified and applied to a variety of stringed instruments.

What is claimed is new and desired to be protected by Letters Patent is set forth in the appended claims:

1. An apparatus for a finger of a user to play a stringed instrument, the finger having a finger diameter, the apparatus comprising:

a string pick configured to pick strings of the stringed instrument, and having a tip end, a tail end opposite the tip end, a pick body extending between the tip end and the tail end that is substantially flat, has a first flat face and a second flat face opposite the first flat face, a periphery about the pick body extending between the first flat face and the second flat face, and is tapered at the tip end, the pick body also having a pick axis extending between the tip end and the tail end, a grip axis normal to the pick axis and intersecting the first flat face and the second flat face, a pick length as measured between the tip end and the tail end along the pick axis, and a maximum pick width as measured normal to the pick axis and through the pick body, the maximum pick width greater than the finger diameter, the string pick including a pair of opposing tail side tabs extending outwardly from the pick body, normal to both the pick axis and the grip axis, and defining the maximum pick width; and an elastic securing band forming a loop about a band center axis, and having a finger end, a pick end opposite the finger end, a band length extending between the finger end and the pick end parallel with the band center axis, a tube wall thickness, a tubular inner surface extending between the finger end and the pick end, and a tubular outer surface opposite the tubular inner surface and extending between the finger end and the pick end, the elastic securing band configured to couple with the string pick via the tail side tabs, and to secure the string pick to the finger of a user via a conformal fit against the finger.

2. The apparatus of claim 1, wherein the elastic securing band is an elastic sleeve having a sleeve length, and configured to extend over and engage the tail side tabs and to secure the string pick against the finger.

3. The apparatus of claim 1, wherein the pick body has a tail portion proximate the tail end, a tip portion proximate the tip end, and a notch portion extending between the tip portion and the tail portion, the tail portion including the pair of opposing tail side tabs, the tip portion including a pair of opposing tip side tabs extending outwardly from the pick body, normal to both the pick axis and the grip axis, and defining a tip maximum width, the tip maximum width less than the maximum pick width, and the notch portion having a notch length as measured between the tail portion and the tip portion along the pick axis, and also having a notch maximum width as measured normal to the pick axis and through the pick body, the notch maximum width less than the tip maximum width.

4. The apparatus of claim 3, wherein the notch length is at least as long as the band length.

5. The apparatus of claim 3, wherein the periphery of the pick body includes a pair of opposing convex curves on each side of the pick axis in the notch portion of the pick body, each extending the notch length.

6. The apparatus of claim 3, wherein the tip side tabs and the tail side tabs are configured to engage with the elastic securing band such that the string pick is secured to the finger.

7. The apparatus of claim 3 wherein the notch maximum width is greater than the finger diameter.

8. The apparatus of claim 1, wherein the tubular inner surface has a greater coefficient of friction than the tubular outer surface.

9. The apparatus of claim 1, wherein the tip side tabs or the tail side tabs have a radius of curvature of at least about 0.040 inches as measured in a plane normal to the grip axis.

10. The apparatus of claim 2, wherein the sleeve length is equal to or greater than the pick length.

11. The apparatus of claim 2, wherein the tail side tabs are configured to secure the string pick to the finger via the elastic sleeve such that the string pick is supported completely by the finger.

12. The apparatus of claim 1, wherein the elastic securing band is made of latex or silicone rubber.

13. The apparatus of claim 1, wherein the elastic securing band is configured to tighten about the finger upon rotation of the string pick about the finger.

14. The apparatus of claim 1, wherein the elastic securing band has a tube wall thickness of at least 0.035 inches.

15. The apparatus of claim 2, wherein the tail side tabs of the string pick are engaged by the elastic sleeve such that the tip end of the string pick may be adjusted along the pick axis.

16. The apparatus of claim 1, wherein the elastic securing band is configured to provide a radial compressive force against a circumference of the finger while allowing for rotation of the string pick to a position away from the pad of the finger.

17. An apparatus for a finger of a user to play a stringed instrument, the finger having a finger diameter, the apparatus comprising:

a string pick configured to pick strings of the stringed instrument, and having a tip end, a tail end opposite the tip end, a pick body extending between the tip end and the tail end that is substantially flat, having a first flat face and a second flat face opposite the first flat face, a periphery about the pick body extending between the first flat face and the second flat face, and is tapered at the tip end, the pick body also having a pick axis extending between the tip end and the tail end, a grip axis normal to the pick axis and intersecting the first flat face and the second flat face, a pick length as measured between the tip end and the tail end along the pick axis, and a maximum pick width as measured normal to the pick axis and through the pick body, the maximum pick width greater than the finger diameter, the string pick including a pair of opposing tail side tabs extending outwardly from the pick body, normal to both the pick axis and the grip axis, and defining the maximum pick width; and an elastic securing band forming a loop about a band center axis, and having a finger end, a pick end opposite the finger end, a band length extending between the finger end and the pick end parallel with the band center axis, a tube wall thickness, a tubular inner surface extending between the finger end and the pick end, and a tubular outer surface opposite the tubular inner surface and extending between the finger end and the pick end, the elastic securing band configured to couple with the string pick via the tail side tabs, and to secure the string pick to the finger of a user via a conformal fit against the finger; and wherein the elastic securing band is an elastic sleeve having a sleeve length, and configured to extend over and engage the tail side tabs and to secure the string pick against the finger;

wherein the pick body has a tail portion proximate the tail end, a tip portion proximate the tip end, and a notch portion extending between the tip portion and the tail portion, the tail portion including the pair of opposing tail side tabs, the tip portion including a pair of opposing tip side tabs extending outwardly from the pick body, normal to both the pick axis and the grip axis, and defining a tip maximum width, the tip maximum width less than the maximum pick width, and the notch portion having a notch length as measured between the tail portion and the tip portion along the pick axis, and also having a notch maximum width as measured normal to the pick axis and through the pick body, the notch maximum width less than the tip maximum width;

wherein the notch length is at least as long as the band length;

wherein the periphery of the pick body includes a pair of opposing convex curves on each side of the pick axis in the notch portion of the pick body, each extending the notch length;

wherein the tip side tabs and the tail side tabs are configured to engage with the elastic securing band such that the string pick is secured to the finger;

wherein the notch maximum width is greater than the finger diameter;

wherein the tubular inner surface has a greater coefficient of friction than the tubular outer surface;

wherein the tip side tabs or the tail side tabs have a radius of curvature of at least about 0.040 inches as measured in a plane normal to the grip axis;

wherein the sleeve length is equal to or greater than the pick length;

wherein the tail side tabs are configured to secure the string pick to the finger via the elastic sleeve such that the string pick is supported completely by the finger;

wherein the elastic securing band is made of latex or silicone rubber;

wherein the elastic securing band is configured to tighten about the finger upon rotation of the string pick about the finger;

wherein the elastic securing band has a tube wall thickness of at least 0.035 inches;

wherein the tail side tabs of the string pick are engaged by the elastic sleeve such that the tip end of the string pick may be adjusted along the pick axis; and wherein the elastic securing band is configured to provide a radial compressive force against a circumference of the finger while allowing for rotation of the string pick to a position away from the pad of the finger.

18. The apparatus of claim 17, further comprising set of instructions; and wherein the apparatus is arranged as a kit.

19. A method of use for an apparatus for a finger of a user to play a stringed instrument, the method comprising the steps of:

providing a string pick configured to pick strings of the stringed instrument, and having a tip end, a tail end opposite the tip end, a pick body extending between the tip end and the tail end that is substantially flat, has a first flat face and a second flat face opposite the first flat face, a periphery about the pick body extending between the first flat face and the second flat face, and is tapered at the tip end, the pick body also having a pick axis extending between the tip end and the tail end, a grip axis normal to the pick axis and intersecting the first flat face and the second flat face, a pick length as measured between the tip end and the tail end along the pick axis, and a maximum pick width as measured normal to the pick axis and through the pick body, the maximum pick width greater than the finger diameter, the string pick including a pair of opposing tail side tabs extending outwardly from the pick body, normal to both the pick axis and the grip axis, and defining the maximum pick width;

providing an elastic securing band forming a loop about a band center axis, and having a finger end, a pick end opposite the finger end, a band length extending between the finger end and the pick end parallel with the band center axis, a tube wall thickness, a tubular inner surface extending between the finger end and the pick end, and a tubular outer surface opposite the tubular inner surface and extending between the finger end and the pick end, the elastic securing band configured to couple with the string pick via the tail side tabs, and to secure the string pick to the finger of a user via a conformal fit against the finger;

sliding the finger end of the elastic securing band onto the finger of the user;

inserting the tail end of the string pick into the pick end of the elastic securing band as disposed around the finger of the user;

rotating the string pick about the finger of the user;

playing the stringed instrument with the string pick.

20. The method of claim 19, wherein the elastic securing band is an elastic sleeve.

* * * * *